US005628669A

United States Patent [19]

Hesse

[11] Patent Number: 5,628,669

[45] Date of Patent: May 13, 1997

[54] TOY FIGURE WITH SPREADING LEGS

[76] Inventor: Kurt Hesse, Waldstrasse 36, W-8510 Fürth/Bayern, Germany

[21] Appl. No.: 118,892

[22] Filed: Sep. 9, 1993

[30] Foreign Application Priority Data

Sep. 9, 1992 [DE] Germany ..... 42 29 798.2

[51] Int. Cl.[6] ..... A63H 3/46; A63H 3/16

[52] U.S. Cl. ..... 446/382; 446/383

[58] Field of Search ..... 446/376–379, 446/381, 97, 390, 382, 383, 313, 317

[56] References Cited

U.S. PATENT DOCUMENTS

| | | | |
|---|---|---|---|
| 2,754,621 | 7/1956 | Cohn | 446/377 |
| 4,205,482 | 6/1980 | Christiansen et al. | 446/97 |
| 4,952,189 | 8/1990 | Barlow | 446/241 |
| 4,988,324 | 1/1991 | Ryaa et al. | 446/100 X |

FOREIGN PATENT DOCUMENTS

| | | | |
|---|---|---|---|
| 456939 | 9/1913 | France . | |
| 3143496 | 6/1983 | Germany . | |
| 1385653 | 2/1975 | United Kingdom | 446/97 |

*Primary Examiner*—Mickey Yu

*Attorney, Agent, or Firm*—Herbert L. Lerner; Laurence A. Greenberg

[57] ABSTRACT

A toy figure has a body of a downwardly open body shell. Arms are attached to the body shell. A support member is inserted from below into and attached to the body shell. The support member carries legs. The legs are allowed to assume a spread-apart position by spreading the legs outwardly from a defined basic position. An inward biasing force is provided which restores the legs toward the defined basic position. The legs are thus automatically returned from the spread-apart position to the defined basic position.

1 Claim, 6 Drawing Sheets

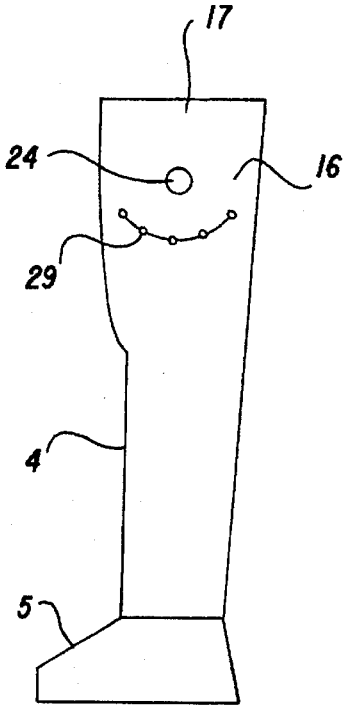
FIG.11a
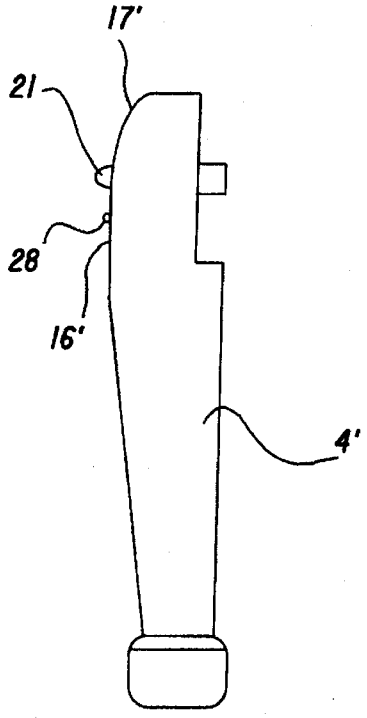
FIG.11b
FIG.12a
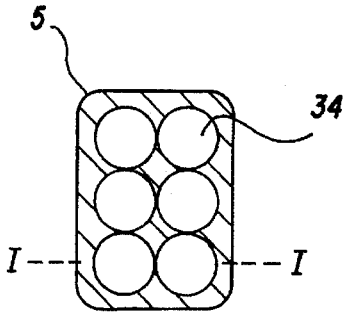
FIG.12b
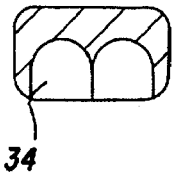
FIG.12c
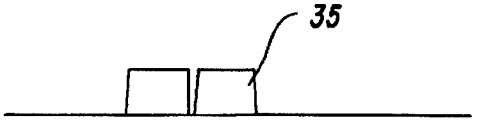

TOY FIGURE WITH SPREADING LEGS

BACKGROUND OF THE INVENTION

1. Field of the Invention

The present invention relates to a toy figure with a downwardly open body shell into which arms and legs are inserted which are movable relative to the body shell, and wherein the legs are fixed by means of at least one support member introduced from below into the body shell and are fixed on the support member in such a way that they can be brought into a spread position.

2. Description of the Related Art

A toy figure of this type is already known from German Patent DE-PS 31 43 496. In that case, the two separately formed legs are pivotably connected with each other via a sort of articulated ball, the articulated ball having pegs disposed on both sides which extend through associated openings in the respective legs and which are fixedly, but pivotably, connected with the support member. Thus, the two legs are pivotable in the way of a ball and socket joint, the respective foot also being connected with the associated leg via a ball and socket joint. A change in the foot position can take place depending on the position of the leg in order to assure a secure upright positions of the toy figure.

That prior art toy figure has no predefined basic position and its position can be arbitrarily changed. Beyond this, the toy figure is unsuitable for use with other parts of a set, for example for use as a horseman, where the figure takes up a stable position on the back of a toy horse. Finally, the known configuration has the disadvantage that the toy figure requires great manufacturing effort because of the plurality of parts needed. That, in turn, results in high production costs.

SUMMARY OF THE INVENTION

It is accordingly an object of the invention to provide a toy figure with spreading legs, which overcomes the hereinafore-mentioned disadvantages of the heretofore-known devices of this general type and which improves the toy figure of that species in such a way that it can basically take up a spread position from a base position of the legs, particularly including the capability to secure the toy figure effectively on the back of a toy horse, a toy bicycle, a toy motorcycle or the like. It is another object of the invention to provide a toy figure which, in its construction, is simple and easy to manufacture.

With the foregoing and other objects in view there is provided, in accordance with the invention, a toy figure, comprising a downwardly open body shell, arms attached to the body shell, a support member to be inserted into and attached to the body shell, legs attached to the support member, means operatively associated with the support member and the legs for allowing the legs to assume a spread-apart position by spreading the legs outwardly from a defined basic position; and force means for providing a restoring force for biasing the legs toward the defined basic position and for automatically returning the outwardly spread-apart legs into the defined basic position.

In accordance with an added feature of the invention, the toy figure includes pivot means for allowing the legs to pivot about an axis extending transversely with regard to the body shell.

A most important aspect of the invention is found in defining of two legs of the toy figure in a so-called basic position, i.e. normal position. In this respect, the legs are supported on the support member in such a way that they are outwardly pivotable on the support member. This assures a spread position relative to the transverse direction of the body. Transverse, in this respect, is defined as parallel to the broadside of the body, and longitudinal is defined as a forward/rearward direction.

The support member can be embodied in the most varied forms, even the body itself can be considered as the support member, as long as the legs are directly connected to the body. Besides this, means are provided for establishing a restoring force, so that the spread legs return to the defined basic position when they are released.

The invention assures the possibility of connecting the toy figure with different parts of the toy set. Because of the possibility to set the spread angle of the two legs variably, wherein the restoring force acts simultaneously on both legs, the toy figure of the invention can be connected with the most varied objects of different widths. In this case the restoring force acts in a stabilizing manner with regard to the seating of the toy figure on the respective object.

In its basic position, the toy figure of the invention provides an image which to a great extent corresponds to a natural standing position, wherein—if required—the leg position can be changed into a spread position.

Because, in accordance with another feature of the invention, the two legs are additionally pivotable about an axis extending crosswise to the two legs, the toy figure can take up a seated position so that it can be placed into a toy car, on a chair, on a swing, or the like.

In accordance with an added feature of the invention, the pivot means lock the legs together so that the legs can only be pivoted together about the transverse axis. In a number of embodiments, the legs are constructed such that they are not pivotable relative to one another. If, for example, the two legs are moved from a pivoted position (seated position) back into the normal position, i.e. basic standing position of the toy figure, it is always assured that a secure upright position of the toy figure is attained.

Alternatively, however, there is also the possibility within the scope of the invention to embody the two legs separately pivotable from each other. Therefore, there is provided in accordance with an additional feature of the invention, that the pivot means allow separate pivoting of the legs independently of one another.

In accordance with a further feature of the invention, the legs have a bottom disposed away from the body shell and a crutch region, and a tapered surface formed on each of the legs at the crutch region, the tapered surfaces of the legs facing one another and defining cam surfaces. The tapered surface on the inside faces of the legs, i.e. the surfaces of the legs facing one another form cam surfaces. When the legs are pivoted into the spread position, a roll-off takes place on the inside of the two legs. The result is a continuous spreading movement. In addition thereto, this construction has the advantage that in the course of spreading, the width between the two legs in the crutch region is not noticeably increased in itself, so that it is possible to use a support member of the customary type and no additional constructive steps are required.

In accordance with again an added feature of the invention, the force means include a fastening member interconnecting the legs, the restoring force being generated by a resilient deformation of the fastening member. The connecting member between the two legs thus takes up a dual function.

In accordance with a preferred feature of the invention, the support member is a clamp-shaped member with two extensions each supporting a respective one of the legs, the support member defining the force means by a resilient deformation thereof when the legs are spread outwardly, the resilient deformation establishing the restoring force on the legs. The support member is preferably disposed on the outside of the respective leg. When the legs are pivoted into the spread position, a deformation of the support member is caused, which provides the restoring force. Thus, in one way the support member acts as a fastening part of the two legs inside the body and in another way as restoring spring.

In accordance with again another feature of the invention, the legs are separate parts. This is advantageous from a production viewpoint.

In accordance with yet an added feature of the invention, the toy figure includes means for defining the basic position, the defining means being in the form of flat contact surfaces provided on inner surfaces of the legs, the basic position being defined when the flat contact surfaces are in mutual contact. In other words, with the structure an exactly defined basic position is assured in which the two flat surfaces rest on each other.

In accordance with yet another feature of the invention, the toy figure includes fastening means attached to the legs for preventing the legs to be pivoted about an axis extending transversely relative to the body shell while allowing spreading of the legs into the spread-apart position. In the case of separate legs, a horizontal displacement of the legs relative to one another and/or pivoting of the legs relative to one another in the sense of a walking position is thus prevented. In a play situation, such would disadvantageously reduce the stability of the toy figure.

In accordance with yet a further feature of the invention, the legs are defined as first and second legs, and the toy figure includes an attachment protrusion formed on the first leg, the second leg having a recess formed therein, the attachment protrusion and the recess together forming a tongue-and-groove connection between the first and second legs. This prevents horizontal displacement of the two legs relative to one another but, at the same time, makes possible the pivoting of the legs into the spread position. This configuration is particularly easy to realize technically. All that is required in this embodiment, is to provide a groove on one leg, which is engaged by a corresponding counterpiece in the shape of a protrusion on the other leg to form a tongue and groove connection.

In accordance with again another feature of the invention, the fastening means are formed by a transverse extension member disposed on an upper end of one of the legs and a complementary recess formed in the other of the legs in which the transverse extension member engages. It is preferable if this transverse extension is already formed on the respective leg in the course of the molding process. In addition, it can act as an additional spring to assure the restoring force. However, for this purpose the transverse extension should be connected with the recess of the adjoining leg via a clamping or snap connection, for example.

In accordance with again an added feature of the invention, the legs are hollow legs, and the toy figure includes a fastening insert having two prong extensions and a cross strut, the prong extensions being inserted into respective ones of the hollow legs.

In accordance with another feature of the invention, the force means include a spring disposed in a crutch area of the legs, the spring applying a restoring force when the two legs are in the spread-apart position. Any pivoting which would simulate a walking position is prevented in this embodiment and, in addition, a certain restoring force is generated in the spread position of the two legs.

In accordance with yet another feature of the invention, the transverse extension member is fixedly connected with the other of the legs.

In addition to or in place of the possible structures for generating a restoring force so far described, in accordance with a further embodiment of the invention it is possible to dispose a spring in the upper part of the two legs which, in the spread position of the legs, generates a restoring force or torque. In the spread position of the legs the spring is compressed and, when the legs are released, the spring pushes the two legs back into the spread position. If the spring is disposed below the pivot point it is understood that the spring is stretched when the legs are spread apart.

In accordance with another feature of the invention, a peg is formed on the outside of the respective leg, the force generated in the course of spreading the legs is achieved by a deformation of the support member, in particular its lateral extensions, via the peg and a respectively formed hole or bore in the support member. The support member is suitably made of a resilient material, such as plastic. The support member thus stores the energy transferred by the spreading force. When the legs are released, the stored energy is released via the torque on the legs to return them to the basic position.

In accordance with again another feature of the invention, the feet of the toy figure are connected fixed against relative movement with the legs. This assures secure stability of the toy figure in the basic position.

In accordance with yet a further feature of the invention, the support member and the legs are inserted into the body shell such that the connection between the support member and the legs is covered. When the two legs are spread apart, the spreading does not only cause a deformation of the support member, but also a certain deformation of the body. Due to this the body itself makes an additional contribution to the restoring force because of its own resilience.

In accordance with yet another feature of the invention, the toy figure includes means for locking the legs in positions in which the legs are pivoted about the transverse axis relative to one another. The locking means may be tongue and groove-type snaps disposed on the legs for defining preset pivot positions and walking positions. And, in a preferred embodiment, the toy figure includes flat contact surfaces provided on inner surfaces of the legs, the flat contact surfaces of the legs contacting one another in the basic position, the locking means being in the form of at least one protrusion disposed on one of the flat contact surfaces, the at least one protrusion engaging a corresponding recess formed the other of the flat contact surface. This structure applies to embodiments of the toy figure which allow a pivoting of the legs relative to one another in the longitudinal direction, simulating a walking motion.

In accordance with an additional feature of the invention, the feet have one or several indentations formed therein on an underside thereof, the indentations being means for connecting the toy figure to one or several protrusions formed on an associated piece of a playset. The toy figure of the invention can be connected via a clamping device, for example with a protrusion of another part of the set, such as a base plate or the like.

In accordance with a further feature of the invention, the attachment protrusion are two plate-like connecting members disposed at a distance from and parallel to one another on the first leg, and the recess formed in the second leg being in the form of two recesses for receiving the two plate-like connecting members.

In accordance with again a further feature of the invention, the legs have outer walls with inner surfaces, the force means including a pressure spring element disposed in a crutch region of the legs above a pivot axis of the legs, the spring element having outer ends contacting the inner surfaces of the outer walls, the pressure spring element being inserted between the plate-like connecting members.

In accordance with a concomitant feature of the invention, the pressure spring element is formed of a resilient material and has U-shaped spring tabs formed at the outer ends thereof, the spring tabs being the force means by applying an outwardly directed spring force on the inner walls.

Other features which are considered as characteristic for the invention are set forth in the appended claims.

Although the invention is illustrated and described herein as embodied in a toy figure with spreading legs, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 11 is a side-elevational view of a right leg and a front-elevational view of an associated left leg of a toy figure whose two legs can be pivoted relative to each other in a walking motion;

FIG. 12*a* is a bottom-plan view of the foot of a toy figure;

FIG. 12*b* is a cross-sectional view taken along the line I—I of FIG. 12*a*; and FIG. 12*c* is a side-elevational view of protrusions on a part of a set to be connected with the toy figure;

DESCRIPTION OF THE PREFERRED EMBODIMENT

Figure 1:
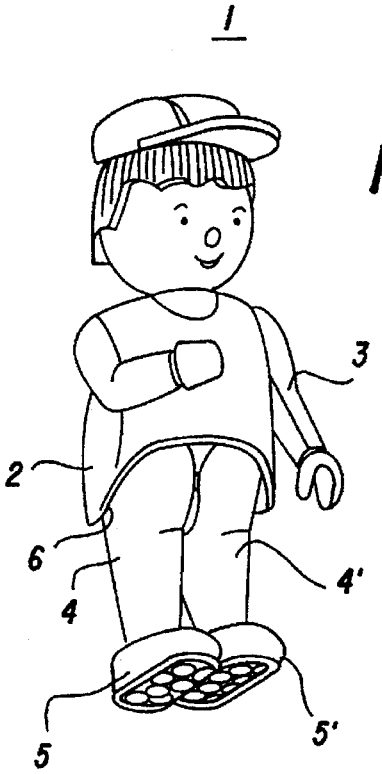
FIG. 1 is a perspective view of the toy figure of the invention.

Referring now to the figures of the drawing in detail and first, particularly, to FIG. 1, thereof, a toy FIG. 1 has a body or body shell 2 with a lower opening 6. The lower opening 6 receives the two legs 4 and 4' of the toy figure. Feet 5 and 5' are connected fixed against relative motion with the respective legs 4 and 4'. Arms 3 are connected at the shoulders of the body shell 2. The arms 3 are preferably rotatable on the body 2, and they are inserted into appropriate recesses or openings in the body shell 2.

Figure 2:
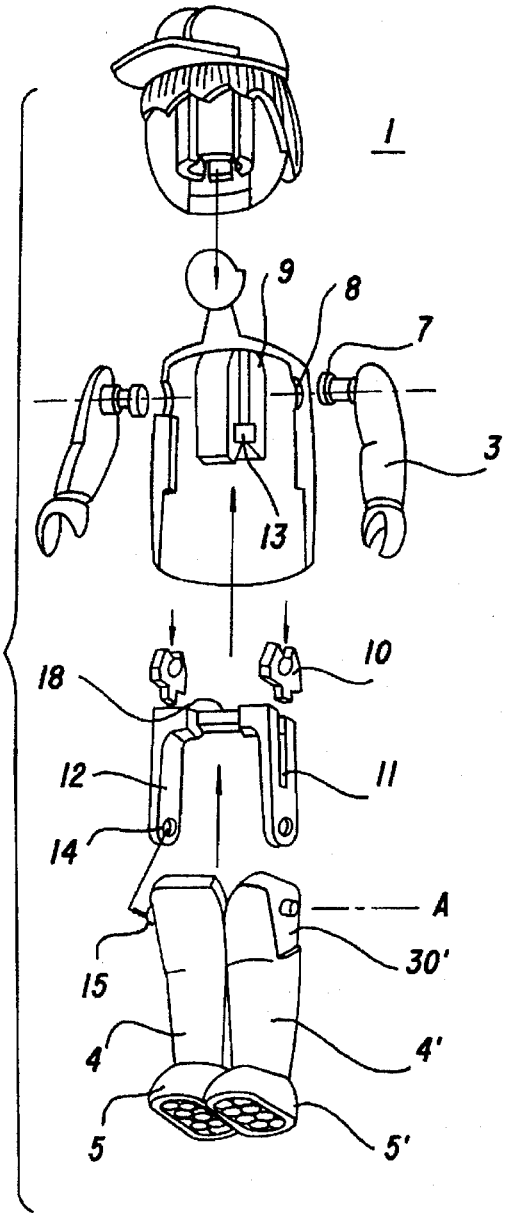
FIG. 2 is a partly broken-away exploded perspective view showing the individual parts of the toy figure.

The illustration of FIG. 2 details how the individual parts are attached on or inside the body shell 2. On the upper end inside the body shell 2, a clamp-like hook or clamp 9 with an inner recess 13 is disposed. A constriction 18 of a support member 12, embodied in the shape of an inverted U, can be snapped into the clamp 9, so that the constriction 18 comes to restin the recess 13.

The support member 12 has two downwardly extending lateral extensions, each with a laterally disposed bore 14 and a groove 11. The bores 14 are used for pivotably connecting the support member 12 with the legs 4 and 4'. The groove 11, when the support member 12 is inserted in the body shell 2, meshes with a ledge in the body shell 2 and it has the task of connecting the support member 12 with a fastener 10 which, in the assembled state, encloses a neck 7 of the arm 3 firmly but rotatably.

The legs 4 and 4' are made separately and are respectively provided in the upper area of the outside with indentations 30 and 30', only the indentation 30' of the leg 4' being visible in FIG. 2. Stubs or pegs 15 and 15' are disposed on the surfaces formed by the indentations 30 and 30'. The pegs 15 engage an opening 14 provided in the support member 12. It is seen that the legs are thus pivotably attached to the support member 12.

Figure 3:
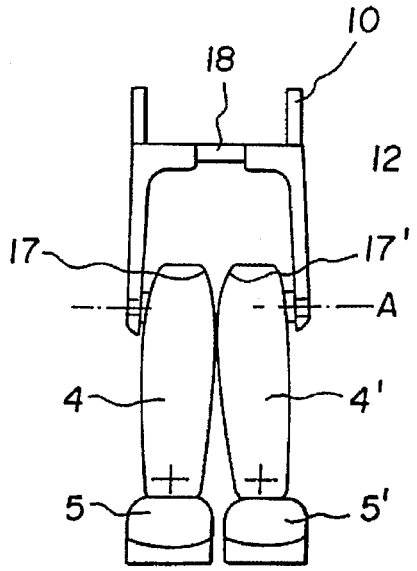
FIG. 3 is a front-elevational view of a lower portion of the toy figure, including the legs and a support member in a basic position.

With reference to FIG. 3, the legs 4 and 4' are provided with tapers 17 and 17' at the top of the legs. The tapers 17 and 17' face each other and—as will be explained later—act in the way of a cam surface during pivoting of the legs and 4' into a spread position.

As can be seen from FIG. 3, the legs 4 and 4' of the toy FIG. 1 are almost placed together in the normal position, i.e. the basic position.

Both legs 4 and 4' can be pivoted about a transverse axis A. This is due to the connection of the pegs 15 in the bores 14 of the support member 12.

Figure 4:
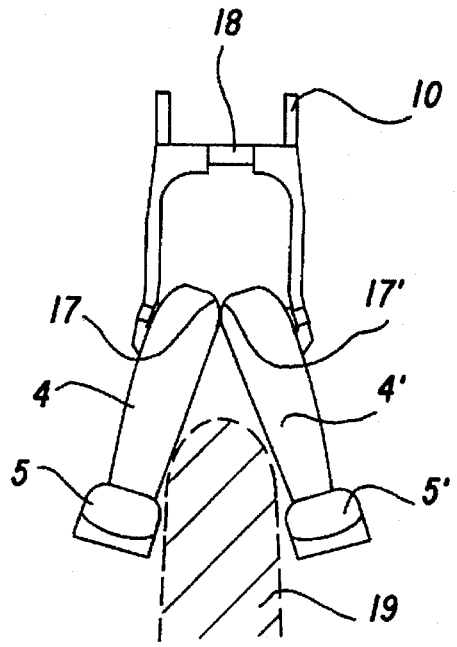
FIG. 4 is a similar view of the lower portion of FIG. 3 in a spread position, for example clamped to a horse back.

Furthermore, the two legs 4 and 4' can be brought into a spread position by pivoting them about two axes oriented perpendicularly to the axis A and into the paper of FIG. 4, for instance. In the spread position, the legs fit over other pieces of a playset, for instance on the back of a horse 19.

When the legs are spread apart, the deformation of the support member 12, schematically indicated in FIG. 4, occurs primarily in the area of the two downward extensions, but possibly also in the transverse area connecting the two sides. The resilient deformation induces a restoring force on the two legs 4 and 4', which results in a particularly effective connection of the toy figure with the part of the playset. The toy figure is positively clamped to the back of the toy horse 19.

As illustrated in FIG. 4, the two cam surfaces formed by the tapers 17 and 17' touch in the spread position of the toy FIG. 1. If the toy FIG. 1 is pulled from the back of the toy horse 19, the two legs 4 and 4' automatically return into the basic position of the toy figure.

Suitably the support member 12 consists of a semi-rigid, resilient material, such as plastic.

Figure 5:
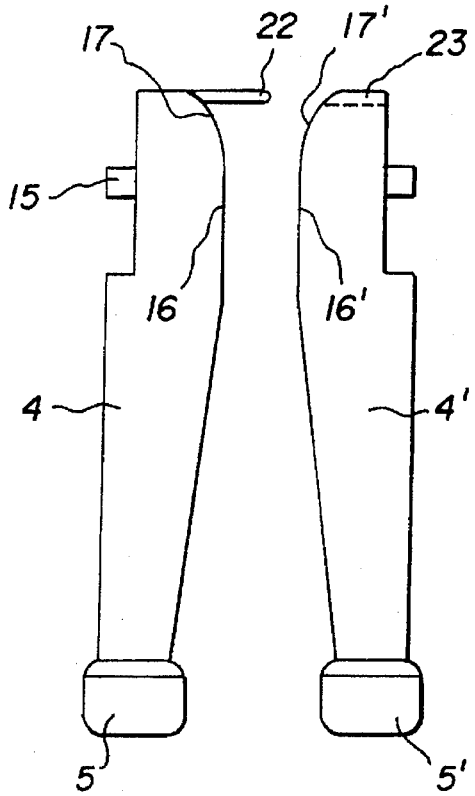
FIG. 5 is a schematic front elevational view of the two legs with fastening means disposed on the upper part in a disassembled state.

FIG. 5 illustrates an embodiment of the legs 4 and 4' of the toy FIG. 1 with special fastening means. These means are intended to prevent the legs from being displaced away from each other in the horizontal direction and/or from pivoting relative to one another about the axis A. Both of these cases have been found to cause the stability of the toy figure to suffer. For this purpose, the leg 4 has a transverse extension 22 disposed on the upper end (see also FIG. 10) which is already formed on in the course of molding (for example injection molding). The transverse extension 22 engages in a corresponding opening or recess 23 in the adjoining upper leg part. When the toy figure is assembled, this structure prevents, on the one hand, a displacement of the two legs 4 and 4' towards each other and, on the other hand, a horizontal, i.e. axial displacement of the two legs towards each other. In addition, that configuration can induce a certain restoring force on the two legs 4 and 4' when in the spread position, provided a fixed connection of the transverse extension 22 in the recess 23 on the adjoining leg has previously been made.

Figure 6:
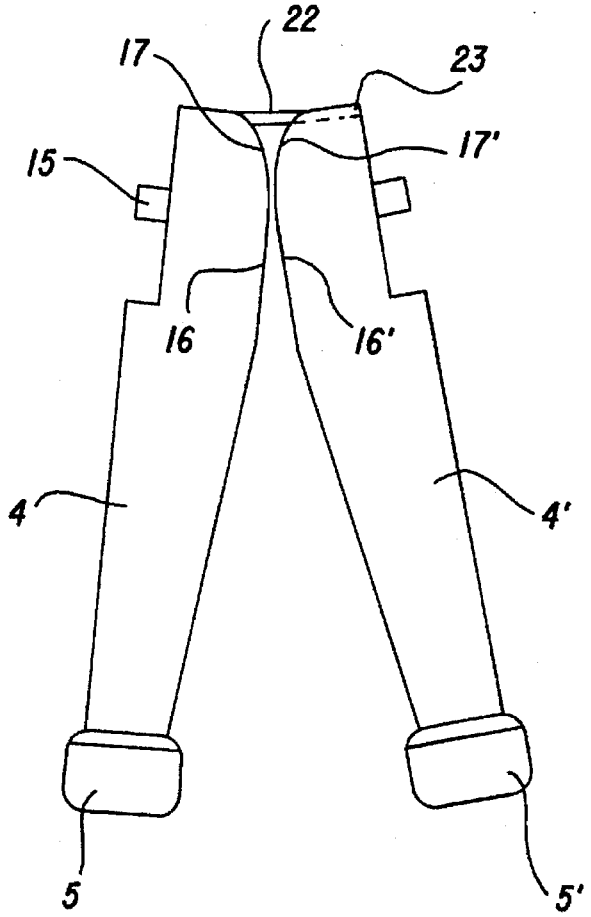
FIG. 6 is a similar view of the two legs of FIG. 5 in the spread position.

FIG. 6 shows the two legs in accordance with FIG. 5 in the assembled and spread position. Flat surfaces 16 and 16' form a gaping V, so that the legs only touch at the taper surfaces 17 and 17', i.e. on the respective cam surfaces.

Figure 7:
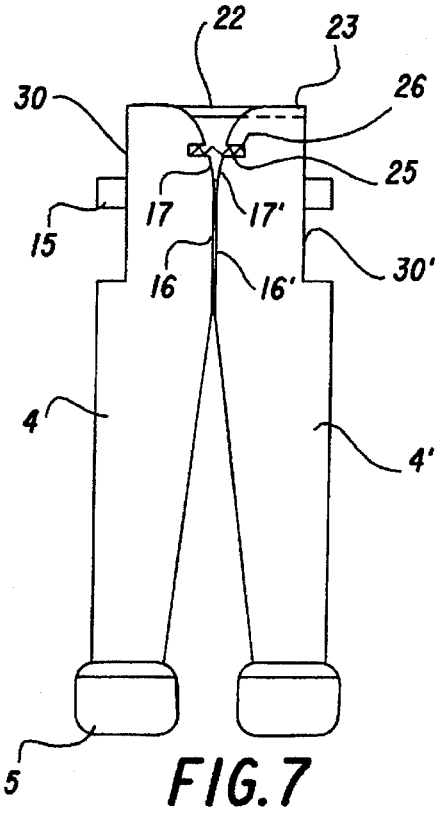
FIG. 7 is a similar view of the embodiment of FIG. 5 and with an additionally provided compression spring.

With reference to FIG. 7, which illustrates another embodiment of the leg connection, a spring 26 is provided in addition to the structure of FIGS. 4 and 5. The spring 26 may be in the form of a compression spring disposed in bores 25 in the legs 4 and 4' above the axis of rotation. In the case of a tension spring it is disposed below the axis of rotation of the pivoting legs 4 and 4'. The spring can be provided either as the sole means or as an additional means for generating a restoring force. The linear restoring force by the spring 26 is translated into a torque about the pivot axis. In that respect, the terms force and torque are interchangeable for the purpose of this application.

Figure 8:
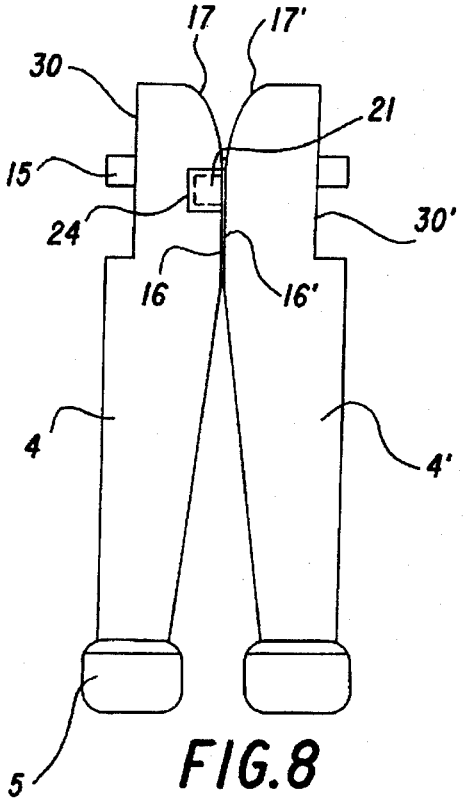
FIG. 8 is a similar view of a further embodiment of the fastening means of the two legs for preventing their horizontal displacement.

FIG. 8 shows yet another embodiment in which a horizontal, i.e. an axial, displacement of the legs 4 and 4' relative to one another is prevented. A recess 24 is provided on one leg, preferably on its level surface 16. A counterpiece 21 or elongated locking stub 21 is provided on the adjoining leg 4' and it engages in the recess 24. If pivoting of the legs 4 and 4' relative to each other is not desired, the shape of the locking stub 21 and of the recess 24 receiving the locking stub 21 should be embodied as a form-locking connection, i.e. a tongue and groove interlock. It is noted, in this context, that a form-locking connection is one which connects two elements together due to the shape of the elements themselves, as opposed to a force-locking or frictional connection, which locks the elements together by force external to the elements. In this way, the stub assures an interlock with the groove 24 during a rotational movement of the legs 4 and 4'.

Figure 9:
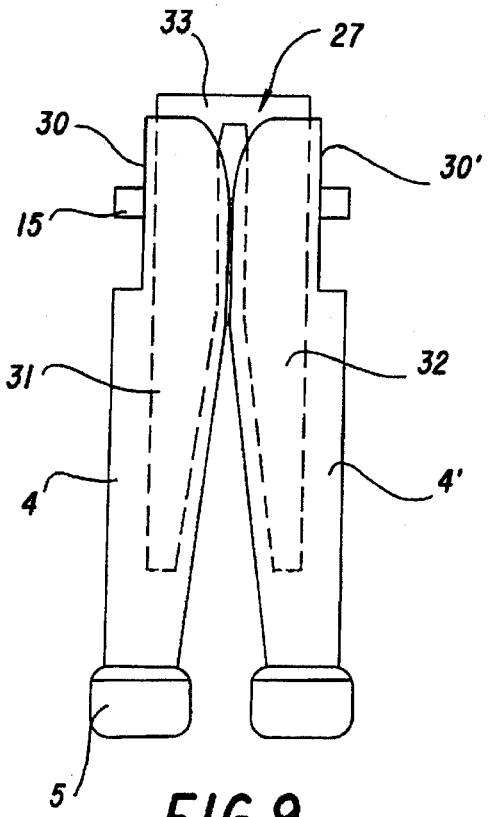
FIG. 9 is a similar view of yet a further embodiment of the fastening means which simultaneously causes a restoring torque or force.

FIG. 9 shows a one-piece insert 27 which has been inserted into the legs 4 and 4', which are embodied hollow for that purpose. The pronged insert 27 comprises two longitudinal extensions 31 and 32 disposed in the hollow space of the respective legs 4 and 4'. The two extensions 31 and 32 are connected via a transverse strut 33. On the one hand, the insert 27 prevents a displacement of the legs 4 and 4' toward each other as well as their pivoting in the sense of a walking position. In addition, the insert 27 provides a restoring spring force when the legs 4 and 4' are spread.

Figure 10:
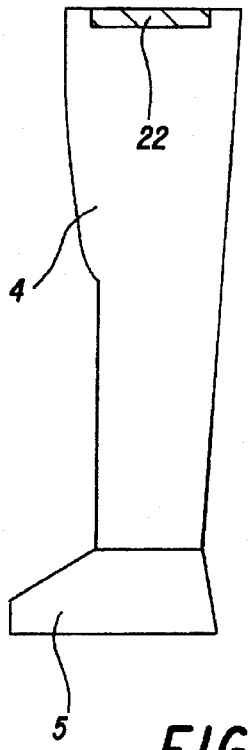
FIG. 10 is a side-elevational view of the embodiment of FIG. 5.

FIG. 10 shows, in a side-elevational view, the right leg of the embodiment according to FIG. 5. In other words, the surface shown is that of the leg 5 which faces the leg 5'.

With reference to FIG. 11, a walking motion is simulated by pivoting the legs 4 and 4' relative to one another about the axis A. For that purpose, the legs may be provided with preset positions. One of the legs, for instance the leg 4 is provided with small indentations 29, which are aligned with small knobs 28 provided on the other leg, for instance the leg 4'. To assure pivotability of the legs 4 and 4' relative to each other, the element 21 is embodied as a rounded peg and the element 24 correspondingly as a rounded recess.

With reference to FIGS. 12*a*–12*c*, each foot 5 and 5' of the toy FIG. 1 is provided with a plurality of recesses 34. Normed protrusions 35 on other parts of a playset can thus be engaged. The toy figure can thus be clamped on a base plate or the like. For this purpose either the lateral areas of the protrusions or the lateral areas of the recesses 34 are made in a cone shape to assure a clamping effect. In this way the toy FIG. 1 can be firmly attached to a base plate or another playset piece.

Figure 13B:
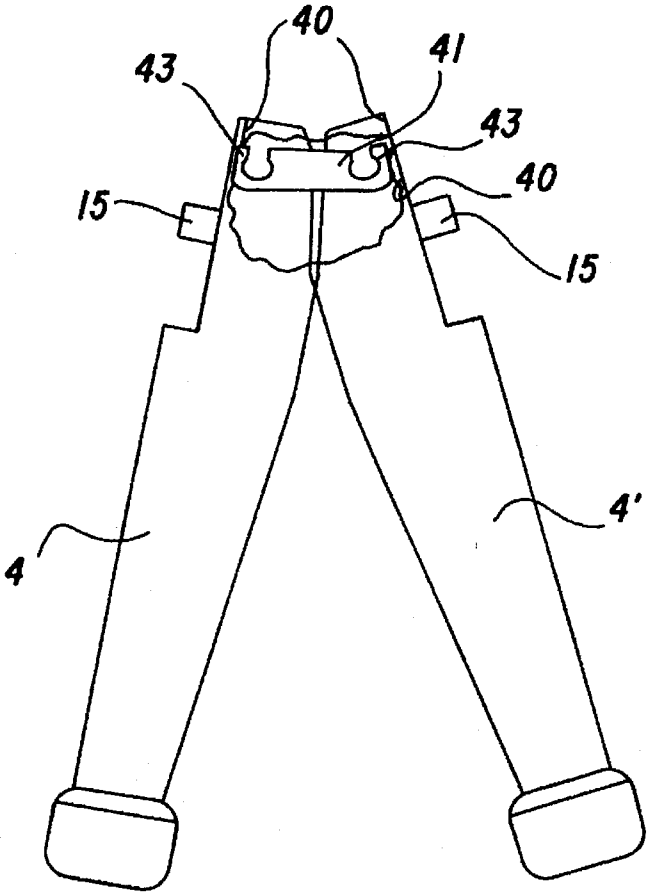
FIG. 13*b* is a partly broken-away, front-elevational view of the embodiment of FIG. 13*a* in an assembled spread position.
Figure 13A:
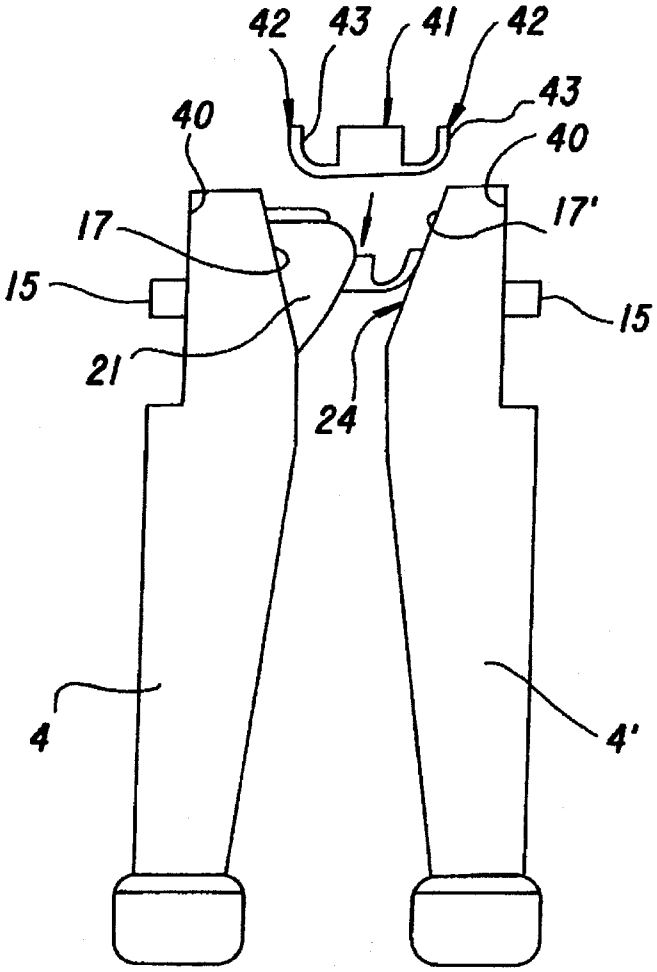
FIG. 13*a* is an exploded view of another embodiment of the leg connection with a further spring element.

FIG. 13 illustrates a particularly advantageous embodiment. The structure pertaining to the mutual hinging of the legs 4 and 4' in the upper thigh region provides great stability, which is generally required for toys.

As compared to the other embodiments, the taper 17 in the crutch region of the legs 4 and 4' is made a little more distinct. The leg 4 is provided with two parallel extending plate-like counterpieces 21 or springs, mutually spaced apart, which enter into associated grooves 24' on the leg 4'. This configuration provides particularly good, stable guidance of the two legs 4 and 4'.

A spring element 41 is now seated between the two counterpieces 21, which in the final assembly position is provided with upward pointing U-shaped spring tabs 43 on its outer ends 42, which act upon the inner walls 40 Of the outsides of the legs 4 and 4' above the pegs 15. This causes a desireable restoring force of the legs 4 and 4' towards the basic position.

By spreading the legs, the spring tabs 43 are pressed together inwardly, as can be seen in the partly broken-away view of FIG. 13*b*.

Not only is the embodiment in accordance with FIG. 13 stable, it can also be easily and rapidly assembled by inserting the spring part 41 into recesses between the counterpieces 21 in the legs 4 and 4' and inserting the legs into the fastening member 12 before that assembly is inserted into the body shell 2.

The foregoing is a description corresponding in substance to German Application P 42 29 798.2, dated Sep. 9, 1992, the International priority of which is being claimed for the instant application, and which is hereby made part of this application. Any material discrepancies between the foregoing specification and the aforementioned corresponding German application are to be resolved in favor of the latter.

I claim:

1. A toy figure, comprising a downwardly open body shell, arms attached to said body shell, a support member inserted into and attached to said body shell, legs attached to said support member, means operatively associated with said support member and said legs for allowing said legs to assume a spread-apart position by spreading said legs outwardly from a defined basic, substantially closed position; and force means for providing a restoring force for biasing said legs toward said substantially closed position and for automatically returning said outwardly spread-apart legs into said substantially closed position, said force means including a transverse extension attached to one of said legs and a corresponding opening formed in the other of said legs receiving said extension.

* * * * *